US005718284A

United States Patent [19]

Nishishita

[11] Patent Number: 5,718,284

[45] Date of Patent: Feb. 17, 1998

[54] LAMINATED HEAT EXCHANGER

[75] Inventor: Kunihiko Nishishita, Konan, Japan

[73] Assignee: Zexel Corporation, Tokyo, Japan

[21] Appl. No.: 751,423

[22] Filed: Nov. 18, 1996

[30] Foreign Application Priority Data

Nov. 24, 1995 [JP] Japan ..... 7-329911

[51] Int. Cl.[6] ..... F28D 1/03

[52] U.S. Cl. ..... 165/134.1; 165/153; 165/176

[58] Field of Search ..... 165/153, 176, 165/134.1; 62/515

[56] References Cited

U.S. PATENT DOCUMENTS 5,176,206 1/1993 Nagasaka et al. ..... 165/153

5,447,194 9/1995 Hayashi et al. ..... 165/153 X

*Primary Examiner*—Leonard R. Leo

*Attorney, Agent, or Firm*—Wenderoth, Lind & Ponack

[57] ABSTRACT

In a laminated heat exchanger having tube elements alternatingly laminated with fins, the plate thickness of an end plate is made smaller than the plate thickness of a formed plate constituting the tube element at the extreme end. Since the end plate becomes deformed more easily than the formed plate, even if pin holes are formed in the bonding area and condensed water becomes frozen in the pin holes, only the end plate will become distended, preventing deformation of the formed plate. Thus, even if pin holes are formed due to defective brazing in the bonding area of the formed plate which comprises the tube elements at the extreme end and the end plate, the tube element is prevented from becoming frozen and damaged, and the heat exchanging medium is prevented from leaking.

7 Claims, 7 Drawing Sheets

LAMINATED HEAT EXCHANGER

BACKGROUND OF THE INVENTION

1. Field of the Invention

The present invention relates to a laminated heat exchanger employed in an air conditioning system for vehicles, residential buildings and the like. To be more specific, it relates to a laminated heat exchanger with tube elements laminated over a plurality of levels via fins and an end plate bonded to a tube element at an end.

2. Description of the Related Art

Known laminated heat exchangers of this type include the laminated evaporator disclosed in Japanese Unexamined Utility Model Publication No. S61-119077. This heat exchanger is achieved by laminating a plurality of tube elements, each of which is provided with a tank portion formed at its two ends and a passage communicating between these tank portions, providing fins between the tube elements, with adjacent tube elements communicating in the direction of the lamination by bonding them at their tank portions. An end plate is bonded at the tube element located at the outermost position as an integral part during brazing. In addition, this publication discloses a feature whereby the portion of the end plate where it is bonded with the tube element is made to have indentations and protrusions to reduce the bonding area of the end plate and the tube element.

However, in the evaporator described above, while it is true that the reduction in the bonding area of the outermost tube element and the end plate reduces the likelihood of the formation of pin holes caused by defective brazing in the bonding area, there is still a possibility that pin holes will form in the bonding area. Condensed water collected in the area freezes and melts repeatedly, causing the formed plate constituting the tube element and the end plate to deform. This results in cracks forming in the deformed portion, which will cause a coolant leak, and this is a cause for concern.

SUMMARY OF THE INVENTION

In view of the problem mentioned above, an object of the present invention is to provide a laminated heat exchanger in which, even if pin holes do form due to defective brazing in the bonding area, the tube element bonded to the end plate is prevented from becoming frozen and damaged. Consequently, the heat exchanging medium is prevented from leaking.

Accordingly, the features of the laminated heat exchanger according to the present invention are: that tube elements, each of which is constituted by bonding formed plates face-to-face, are laminated over a plurality of levels via fins, that an end plate is bonded through brazing to one of the formed plates constituting the tube element at the extreme end, i.e., the formed plate that is positioned toward the outside, and that the plate thickness of the end plate is made smaller than the plate thickness of the outer formed plate.

In this structure, the outer formed plate, i.e., one of the formed plates constituting the tube element at the extreme end, may have the same shape as that of the formed plates constituting other tube elements or it may be a flat plate. In addition, when the plate thickness of the formed plate to be bonded with the end plate is set, for instance, at 1.0 mm, it is desirable to set the plate thickness of the end plate at, for instance, approximately 0.6 mm, which will ensure that it will be more easily deformed compared to the formed plate.

As a result, since the heat exchanger has a structure in which the plate thickness of the end plate is made smaller than the plate thickness of the formed plate constituting the tube element at the extreme end so that the end plate can deform more easily than the formed plate, even if pin holes are formed in the bonding area of the end plate and the tube element, only the end plate will deform under the force of the condensed water freezing, and this prevents the formed plate from becoming deformed. Consequently, although the end plate may become cracked due to this deformation, only the end plate will be damaged and the tube element will not be affected in any way whatsoever.

BRIEF DESCRIPTION OF THE DRAWINGS

The above and other features of the present invention and the concomitant advantages will be better understood and appreciated by persons skilled in the field to which the invention pertains in view of the following description in conjunction with the accompanying drawings which illustrate a preferred embodiment. In the drawings.

DETAILED DESCRIPTION OF THE PREFERRED EMBODIMENT

The following is an explanation of an embodiment of the present invention with reference to the drawings.

Figure 1:
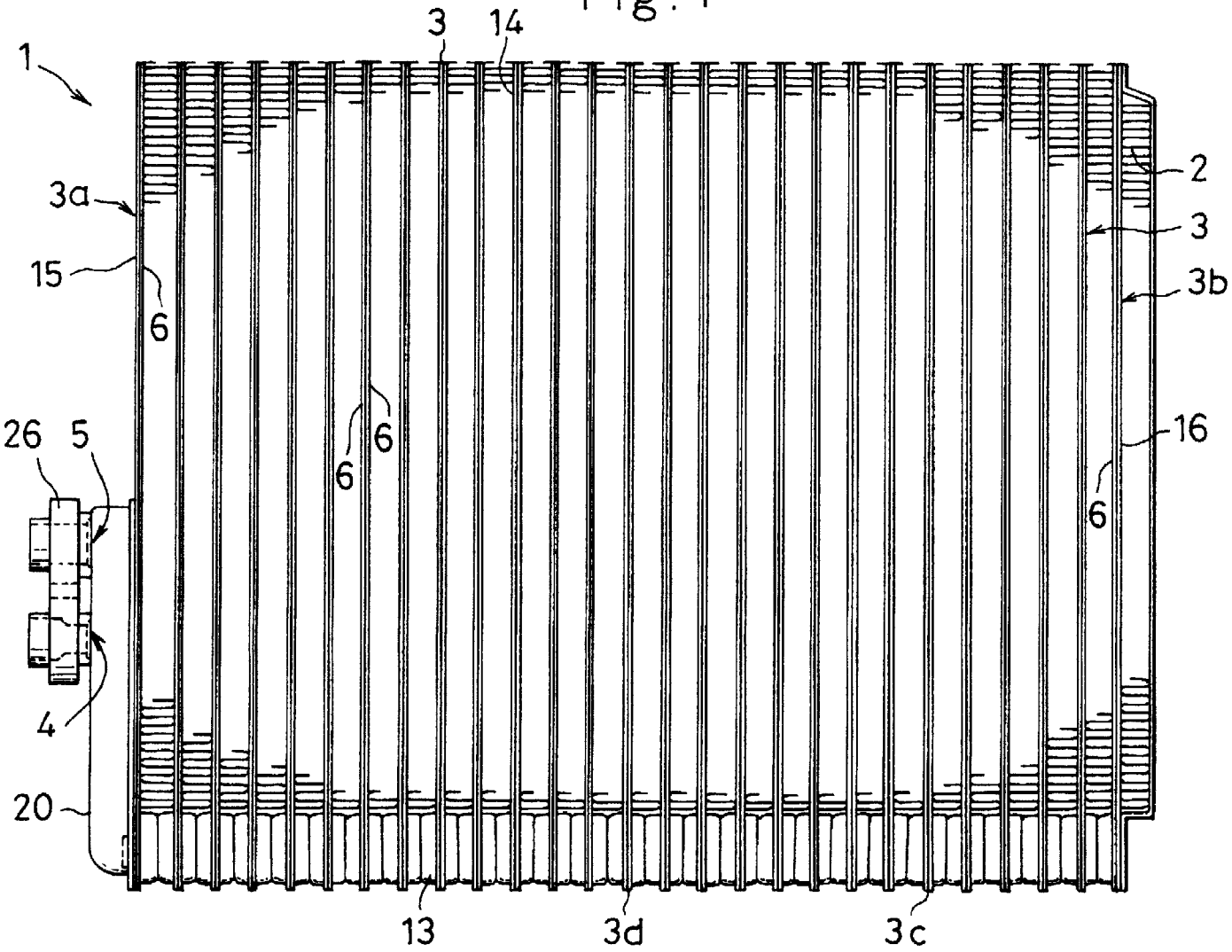
FIG. 1 is a front view of a structural example of a laminated heat exchanger according to the present invention.
Figure 2B:
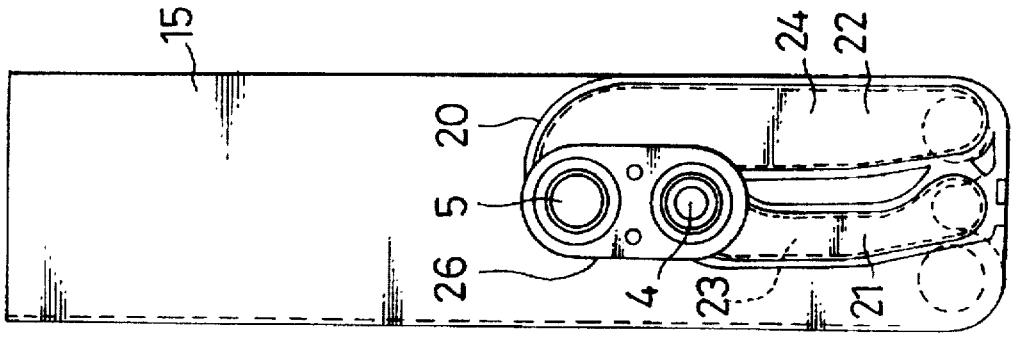
FIG. 2B shows the laminated heat exchanger in FIG. 1 viewed from the side.
Figure 2A:
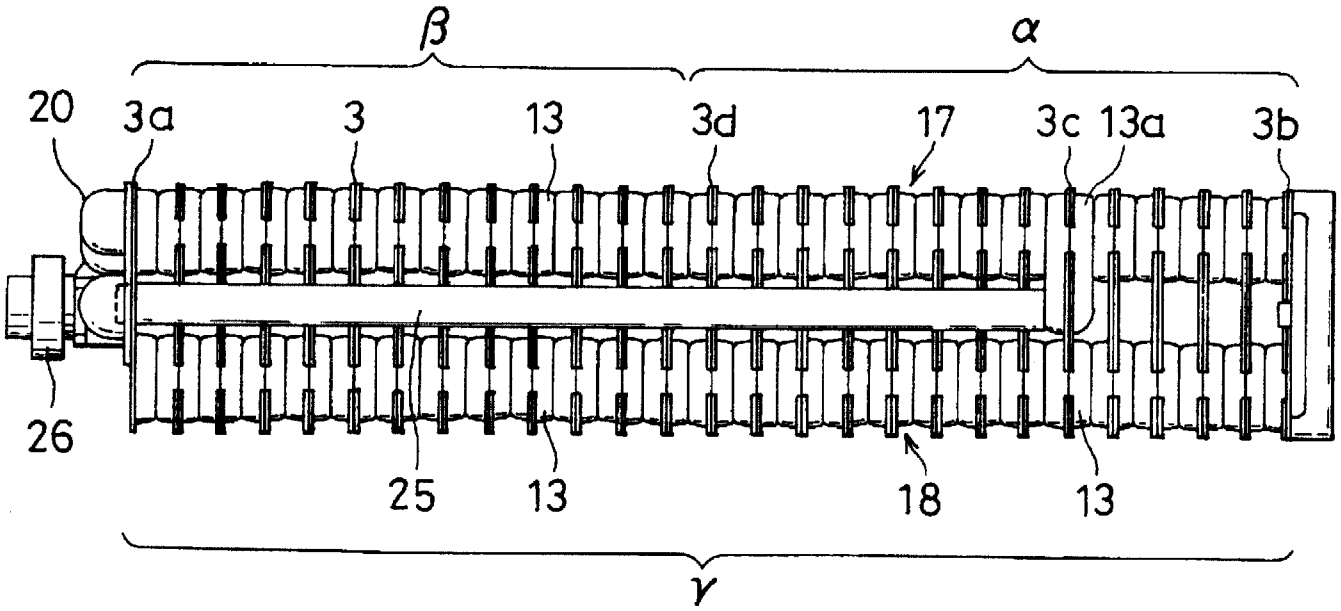
FIG. 2A shows the laminated heat exchanger in FIG. 1 viewed from below.

In FIGS. 1 and 2, which show an evaporator 1 employed in an air conditioning system for vehicles and the like is presented as the laminated heat exchanger, the evaporator 1 may employ a 4-pass method, for instance, with fins 2 and tube elements 3 laminated alternately over a plurality of levels to constitute a core main. An inflow port 4 and an outflow port 5 for coolant are provided at one end in the direction of the lamination of the tube elements 3. The tube elements 3 are each constituted by bonding two formed plates 6, one of which is shown in FIG. 3, face-to-face, except for tube elements **3*a* and 3*b* at the two ends in the direction of the lamination of the core main body, a tube element 3*c*, which is provided with an enlarged tank portion which is to be detailed later, and a tube element 3*d*** positioned approximately at the center.

A formed plate 6 is constituted by press machining an aluminum alloy sheet whose main raw material is aluminum, which is clad with brazing material on both surfaces and which is provided with two bowl-like distended tank portions 8 and 8 at one end and a distended passage portion 9 continuing from the distended tank portions. Between the distended passage portions, an indented pipe mounting portion 10 for mounting a communicating pipe 25, which is to be detailed later, is formed, and in the distended portion for passage formation 9, beads 7, which are arranged with specific regularity and a partitioning wall 11, which extends from a position between the two distended tank portions 8 and 8 to the vicinity of the other end of the formed plate 6, are formed.

The distended tank portions 8 are formed to distend farther than the distended portion for passage formation 9, and the partitioning wall is formed in such a manner that it is on the same plane as a bonding margin 12 at the peripheral edge of the formed plate. As a result, when two formed plates 6 are bonded at their peripheral edges, their partitioning walls 11 become bonded to each other, so that a pair of tank portions 13 and 13 are formed with the distended passage portion 8 which face opposite each other and a U-turn passage 14 connecting between the tank portions is formed by the distended passage portions 9 which face opposite each other.

Figure 3A:
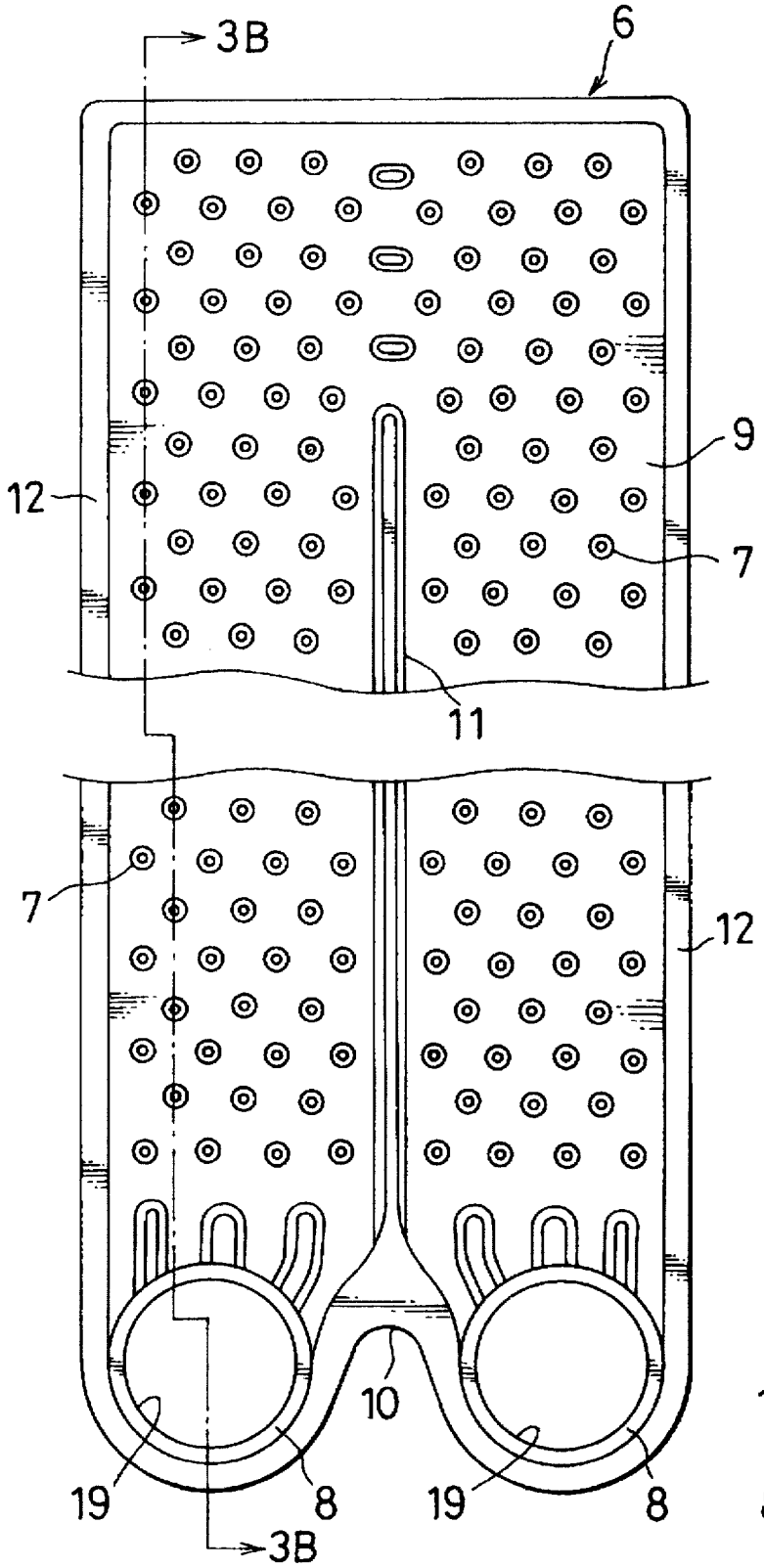
FIG. 3 shows one of the formed plates employed in the laminated heat exchanger shown in FIG. 1, with FIG. 3A showing a front view and FIG. 3B showing a cross section of FIG. 3A through line 3B—3B.
Figure 3B:
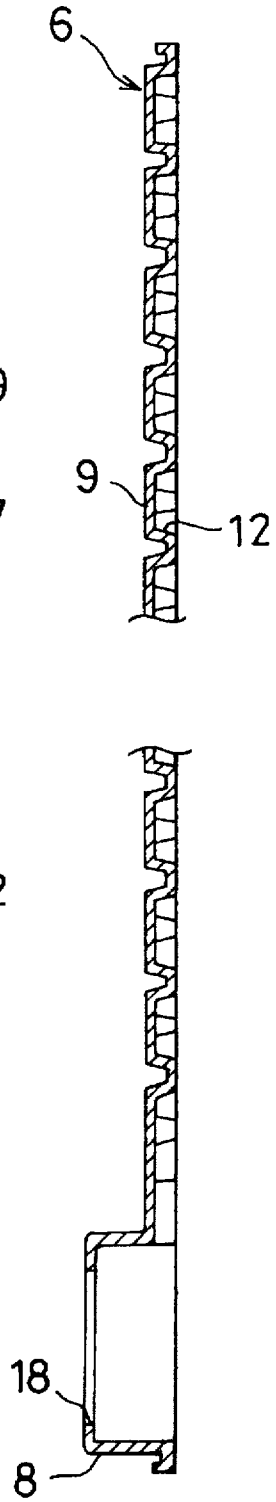
Figure 4A:
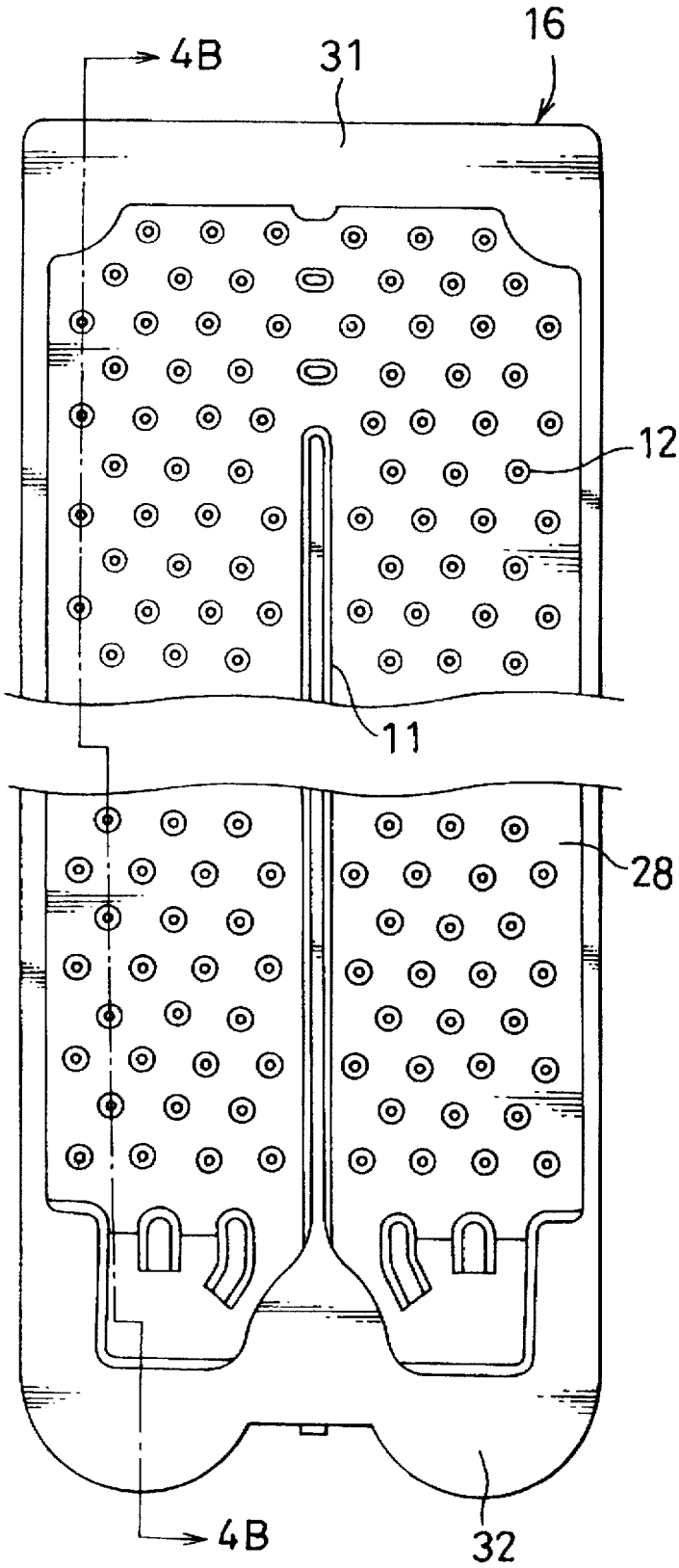
FIG. 4 shows a formed plate employed in the tube element at the extreme end, with FIG. 4A showing a front view and FIG. 4B showing a cross section of FIG. 4A through line 4B—4B.
Figure 4B:
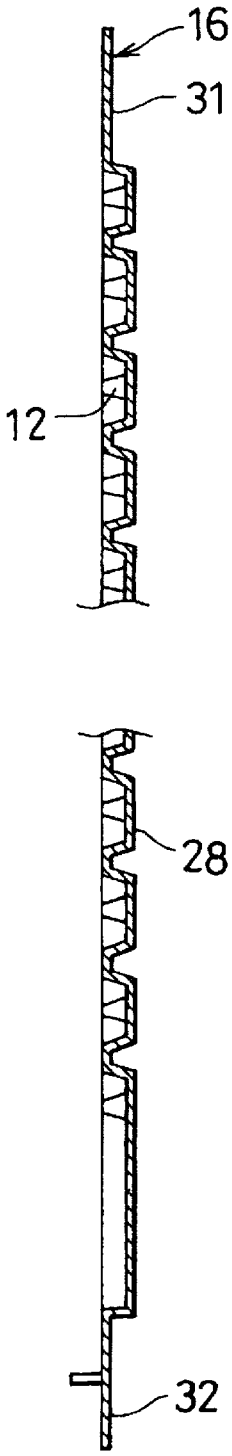

One of the tube elements **3*a* and 3*b* at the two ends in the direction of the lamination, namely, the tube element 3*a*, is constituted by bonding a flat formed plate, having no indentations or projections, to the formed plate 6 shown in FIG. 3 and the other tube element, namely, the tube element 3*b*, is constituted by bonding a formed plate 16 shown in FIG. 4 to the formed plate 6 shown in FIG. 3**.

In addition, the tube element **3*c* is constituted by bonding formed plates, each of which has one of the distended tank portions enlarged so that it approaches the other distended tank portion and, as one result, in the tube element 3*c*, a tank portion 13 whose size is the same as that of the tank portions formed in the other tube elements 3 and another tank portion 13*a* is formed which is enlarged so that the indented pipe mounting portion 10** can be embedded are formed.

Moreover, as shown in FIGS. 1 and 2, in the evaporator 1, adjacent tube elements are abutted at their tank portions 13 and 13 and this series of tank portions thus abutted constitute two tank groups, namely, a first tank group 17 and a second tank group 18, in the direction of the lamination (the direction extending perpendicular to the direction of the air flow). In the first tank group 17, which includes the enlarged tank portion **13*a*, all the adjacent tank portions are in communication via through holes 19 (shown in FIG. 3) formed at the distended tank portions other than the tube element 3*d***, which is located approximately at the center in the direction of the lamination.

In other words, since the tube element **3*d* is constituted by bonding face-to-face the formed plate 6 shown in FIG. 3 and a formed plate which is formed in the same shape but is not provided with a through hole in one of its distended tank portions 8, this tube element 3*d* partitions the first tank group 17 into a first tank block α, which includes the enlarged tank portion 13*a*, and a second tank block β, which communicates with the outflow port 5. In addition, in the second tank group 18, all the tank portions are in communication via the through holes 19** without any partition to thereby constitute a third tank block γ.

As shown in FIGS. 1 and 2, a distribution plate 20 is bonded to the flat formed plate 15 at one end in the direction of the lamination. This distribution plate 20, two bulging portions, i.e., a first bulging portion 21 and a second bulging portion 22 formed through press machining or the like, distend side by side, with the inflow port 4 formed at one end of the first bulging portion 21 and the outflow port 5 formed at the end of the second bulging portion 22 on the same side. By bonding this distribution plate 20 to the flat plate 15, an inflow passage 23 communicating with the inflow port 4, and an outflow passage 24 communicating with the outflow port 5 are formed between these plates. In the inflow passage 23, one end of the communicating pipe 25, whose other end is connected to the enlarged tank portion **13*a*, opens via the flat plate 15, and the outflow passage 24 communicates with the second tank block β via the flat plate 15. A coupling 26 for securing an expansion valve is bonded to the inflow port 4 and the outflow port 5**.

Thus, coolant that has flowed in through the inflow port 4 travels through the inflow passage 23 and the communicating pipe 25 to enter the enlarged tank portion **13*a*, becomes dispersed throughout the entire first tank block α and flows along the partitioning walls 11 in the U-turn passages 14 of the tube elements corresponding to the first tank block α (1st pass). Then it makes a U-turn above the partitioning walls 11 and travels downward (2nd pass) to reach the tank group on the opposite side (3rd tank block γ). After this, it moves horizontally to the remaining tube elements constituting the third tank block γ and flows along the partitioning walls in the U-turn passages 14 of the remaining tube elements (3rd pass). Then it travels downward after making the U-turn over the partitioning walls 11 (4th pass), and is guided to the tank portions constituting the second tank block β, finally flowing out through the outflow port 5 after traveling through the outflow passage 24. During this process, the heat of the coolant is communicated to the fins 2 while the coolant flows through the U-turn passages 14** constituting the first through fourth passes, so that heat exchange is performed with the air passing over the fins.

In contrast, in the formed plate 16 employed in the tube element **3*b*, whose external shape is formed identically to that of the formed plate 6 shown in FIG. 3, the portion which corresponds to the distended passage portion 9 of the formed plate 6 is made to distend to the same degree and beads 7 and a projection 11 are formed in a similar manner in correspondence to the beads 7 and the projection 11 of the formed plate 6, as shown in FIG. 4. Moreover, a distended portion 28 in this formed plate 16 extends to face the distended tank portion 8 of the formed plate 6** to which it is to be bonded face-to-face.

Figure 6A:
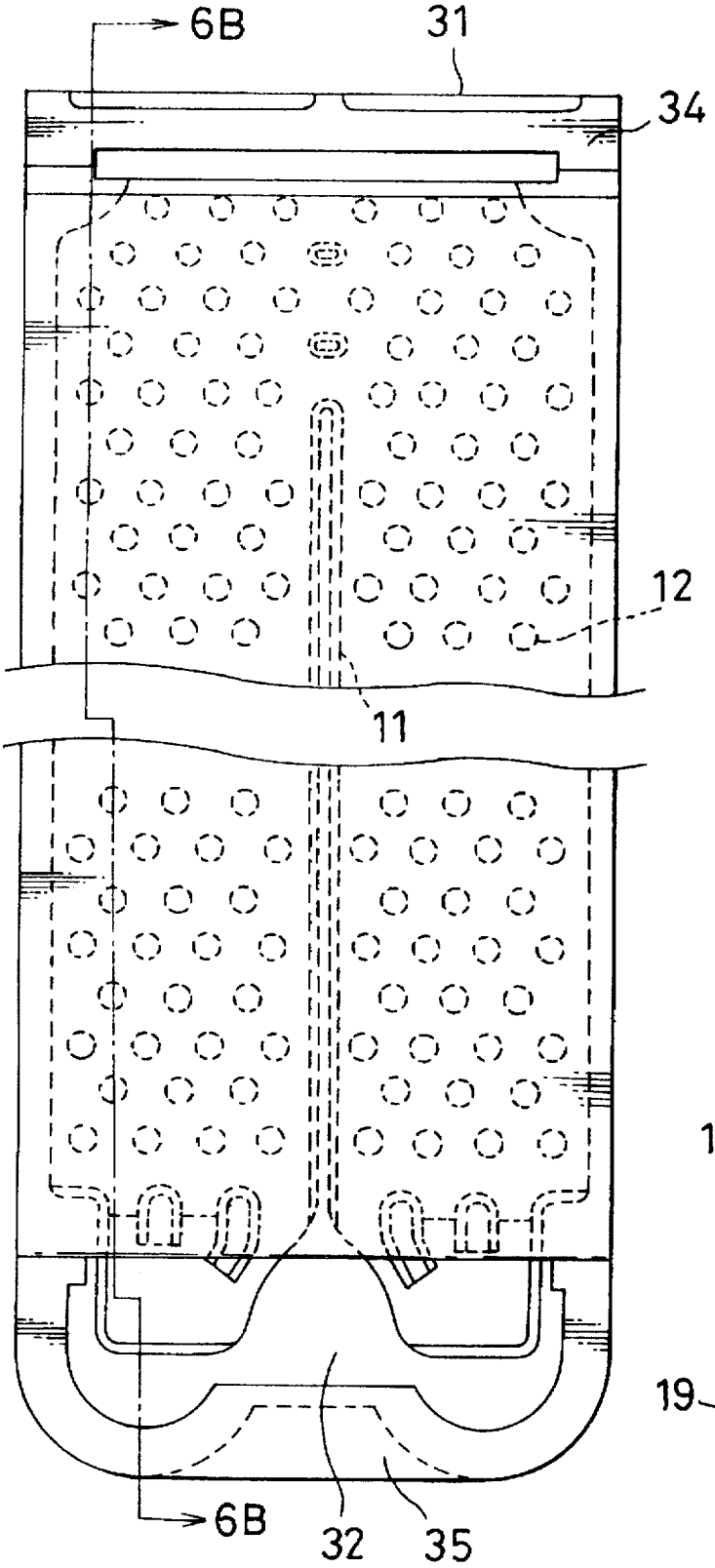
FIG. 6 shows a state in which the tube element at the extreme end and the end plate are bonded, with FIG. 6A presenting a view from the end plate side and FIG. 6B showing a cross section of FIG. 6A through line 6B—6B.
Figure 6B:
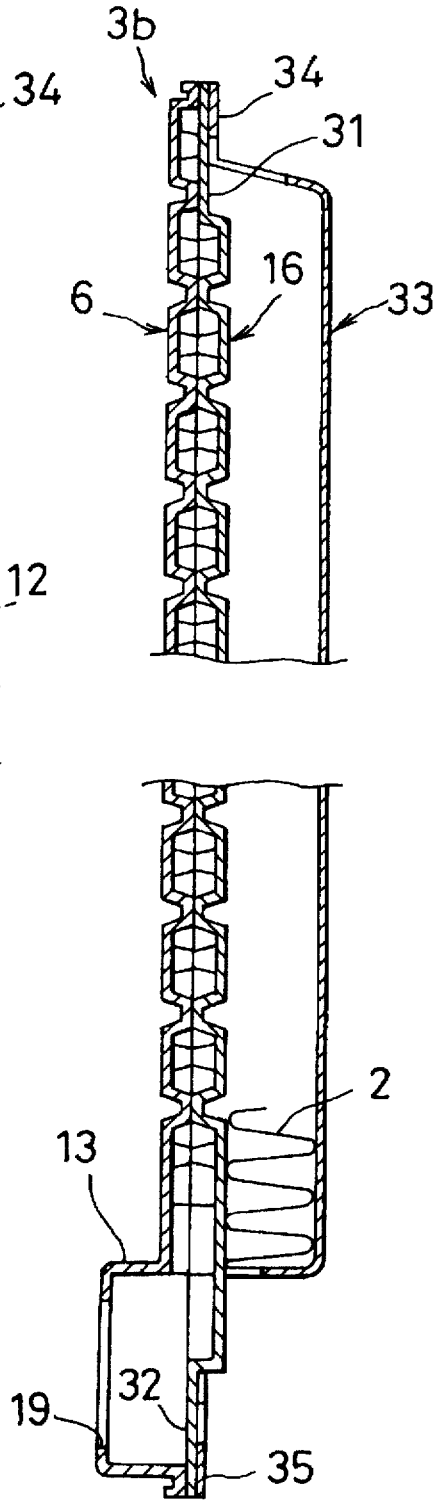

In addition, flat portions 31 and 32, which are not distended, are formed at the two ends of the formed plate 16 in the lengthwise direction. Consequently, when the formed plate 16 and the formed plate 6 are bonded face-to-face, approximately half of the tank portion 13 and the U-turn portion of the U-turn passage 14 are narrowed by the flat portions 31 and 32 as shown in FIG. 6B.

An end plate 33 is bonded to the flat portions of the formed plate 16 toward the outside constituting the tube element **3*b* at the extreme end and a fin 2 is provided between the formed plate 16 and the end plate 33. To describe the end plate 33 more specifically with reference to FIG. 5, its two ends in the lengthwise direction are bent toward the formed plate to form bonding margins, and an upper bonding margin 34 in the figure is placed in contact only with the upper flat portion 31 in the figure, which is formed in the formed plate 16, whereas a lower bonding portion 35 in the figure is placed in contact only with the flat portion 32**. In addition, the plate thickness of the end plate 33 is made smaller than the plate thickness of the formed plate 16 and, in this example, with the plate thickness of the formed plate 16 set at 1.0 mm, which is the same as that of the other formed plates, the plate thickness of the end plate 33 is set at 0.6 mm.

In the evaporator 1 structured as described above, as shown in FIG. 6, the formed plate 6 shown in FIG. 3 clad with a brazing material on both surfaces and the formed plate 16 shown in FIG. 4 likewise clad with brazing material on both surfaces are placed in contact with each other face-to-face, the end plate 33, which is clad only on the side facing opposite the formed plate 16 (clad on one surface, is placed in contact with the formed plate 16 via the fin 2, and the entire assembly including other members is secured with a jig to be brazed in a furnace.

Figure 5A:
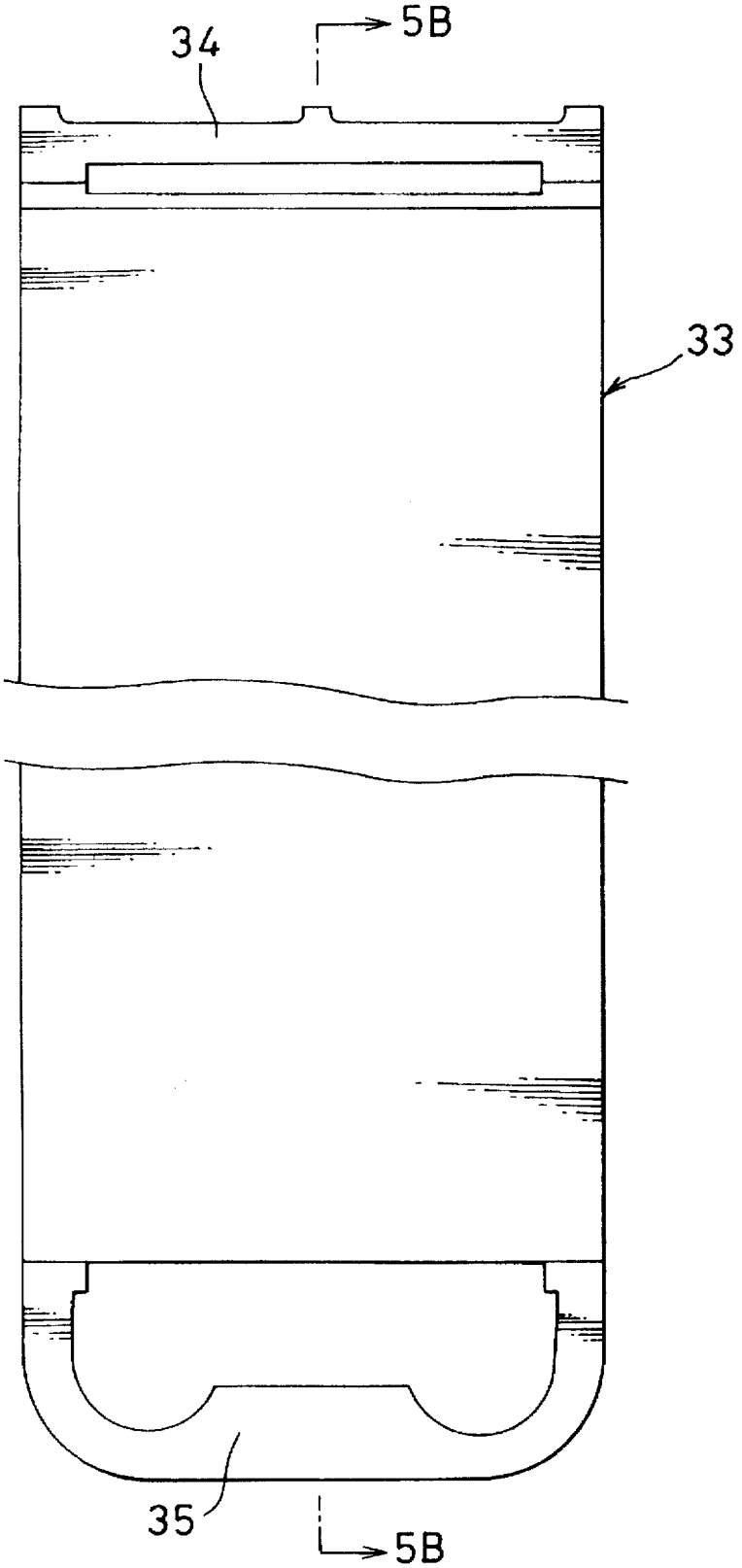
FIG. 5 shows an end plate, with FIG. 5A showing a front view and FIG. 5B showing a cross section of FIG. 5A through line 5B—5B.
Figure 5B:
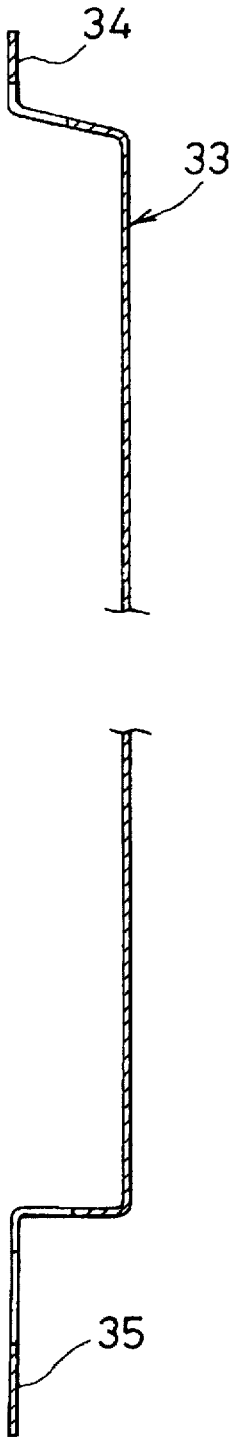

Thus, the formed plate shown in FIG. 3 and the formed plate shown in FIG. 4 are bonded face-to-face to constitute the tube element 3*b* at the end, and the end plate 33 shown in FIG. 5 is bonded to the formed plate 16. Furthermore, since the formed plate 16 and the end plate 33 are bonded only at the flat portions 31 and 32 of the formed plate 16, the bonding can be performed without forming any gaps, achieving reliable brazing.

Figure 7:
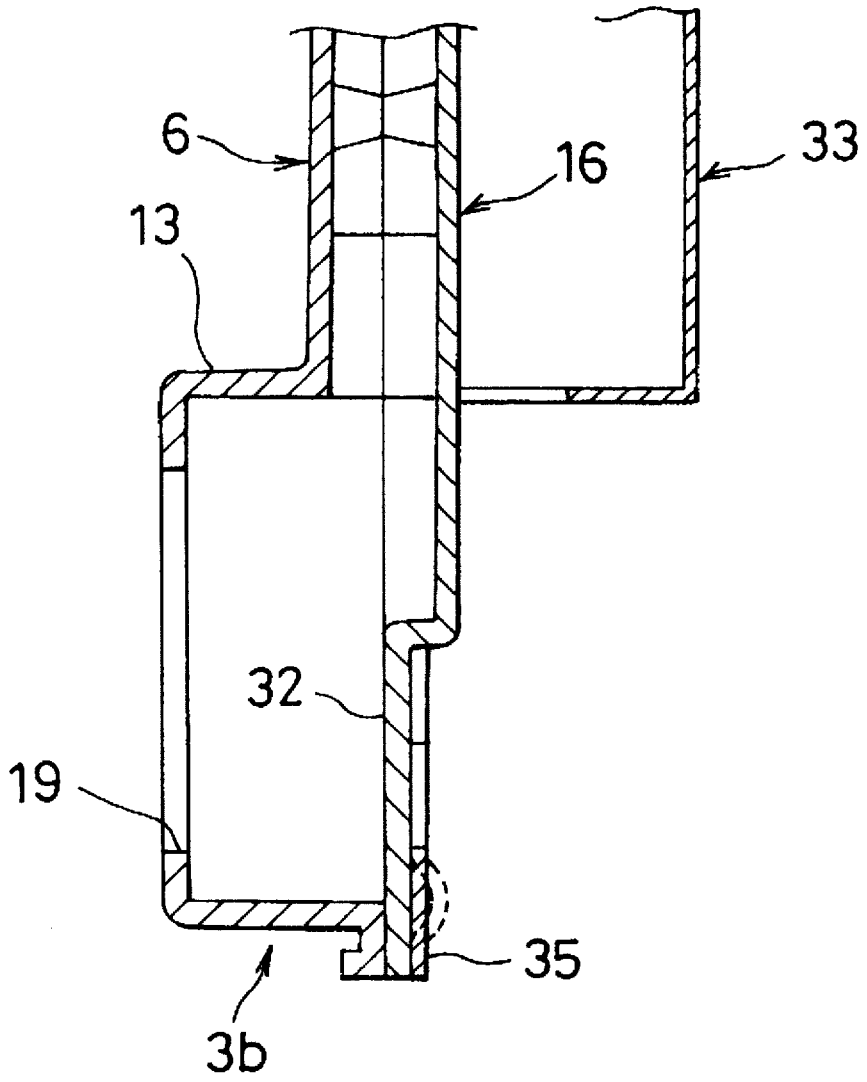
FIG. 7 is an enlarged partial cross section of a state in which the tube element at the extreme end and the end plate are bonded.

Even if pin holes are formed in the bonding area, since the plate thickness of the end plate 33 is set at a smaller value than the plate thickness of the formed plate 16 to ensure that the end plate 33 becomes deformed more easily, the end plate 33 becomes deformed before the formed plate 16 when condensed water becomes frozen, as indicated with the broken line in FIG. 7. Consequently, cracking will occur only in this distended portion of the end plate without affecting the tube element 3*b* in any way whatsoever, precluding the likelihood of a coolant leak.

It is to be noted that the structure of the end portion described above may be adopted in a laminated heat exchanger in the known art in which a core main body is formed by alternately laminating fins 2 and tube elements 3 over a plurality of levels with an intake portion and an outlet portion for heat exchanging medium provided as an integrated portion with the tank portion of a tube element at either the upstream side or the downstream side in the direction of airflow, and it goes without saying that similar advantages can be achieved when the structure is adopted in a heat exchanger in the known art.

As has been explained, according to the present invention, since the plate thickness of the end plate is made smaller than the plate thickness of the formed plate to which it is bonded, ensuring that the end plate can deform more easily than the formed plate, even when pin holes are formed in the bonding area the end plate becomes distended first to inhibit deformation of the formed plate. Consequently, while it is conceivable that the end plate may become frozen and damaged, it will not affect the tube element at the extreme end, making it possible to provide a laminated heat exchanger with a high degree of durability in which the heat exchanging medium does not leak.

What is claimed is:

1. A laminated heat exchanger comprising:

a plurality of laminated tube elements each of which includes two formed plates bonded face-to-face and is provided with distended tank portions and a passage portion distended to a lesser degree than said tank portions and formed continuous to said tank portions;

wherein adjacent tube elements are bonded at said tank portions to communicate with each other;

wherein fins are provided between the passage portions;

wherein an outer formed plate constituting a tube element at an extreme end is bonded to an end plate through brazing material; and wherein a plate thickness of said end plate is smaller than a plate thickness of said outer formed plate so that said end plate will deform more readily than said outer formed plate upon freezing of water in any pin holes in said brazing material, to thereby prevent deformation of said outer formed plate upon such freezing of water in any such pin holes in said brazing material.

2. A laminated heat exchanger according to claim 1, wherein:

in an inner formed plate constituting said tube element at said extreme end, two distended tank portions are formed at one end, a distended passage portion which is distended to a lesser degree than said tank portions is formed continuously to said distended tank portions, beads are formed with a specific regularity in said distended passage portion and a partitioning wall is formed extending from a point between said distended tank portions to a vicinity of another end of said formed plates, in said outer formed plate constituting said tube element at said extreme end, a portion facing opposite said distended passage portion is distended to a degree similar to said distended passage portion, beads and a partitioning wall are formed in correspondence to said beads and said partitioning wall of said inner formed plate, portions facing said distended tank portions are made to distend to a degree similar to said distended passage portion, and non-distended flat portions are formed at two ends in a lengthwise direction, and said end plate is brazed to said flat portions.

3. A laminated heat exchanger according to claim 1, wherein:

a fin is provided between said outer formed plate constituting said tube element at said extreme end and said end plate.

4. A laminated heat exchanger according to claim 1, wherein:

two end portions of said end plate in a lengthwise direction are bent toward said formed plate to form bonding margins, and one of said bonding margins is brazed to one of said flat portions and another of said bonding margins is brazed to another of said flat portions.

5. A laminated heat exchanger according to claim 1, wherein:

a plate thickness of said outer formed plate constituting said tube element at said extreme end is approximately 1 mm and the plate thickness of said end plate is approximately 0.6 mm.

6. A laminated heat exchanger according to claim 1, wherein:

a brazing material is provided on both surfaces of said outer formed plate constituting said tube element at said extreme end and a brazing material is provided only on a side of said end plate that faces opposite said outer formed plate constituting said tube elements at said extreme end.

7. A laminated heat exchanger comprising a plurality of tube element and a plurality of fins provided between adjacent tube elements, wherein:

each of said tube elements includes two formed plates bonded face-to-face, and is provided with a pair of tank portions at one end, a U-turn passage portion communicating between said pair of tank portions and a communicating pipe passing through an area between said pair of tank portions, first and second tank groups are constituted by said tank portions of said plurality of tube elements, said first tank group being divided into an intake-side sub block and an outlet-side sub block by a partition provided at an approximate center in a direction of lamination and said second tank group constituting a single block without being partitioned, an intake/outlet portion communicating with said intake-side sub block and said outlet-side sub block is formed at one end in said direction of said lamination, one of said sub blocks communicating with one side of said intake/outlet portion via said communicating pipe and the other of said sub blocks communicating with another side of said intake/outlet portion, an end plate is provided at a tube element at an extreme end positioned opposite from said one end where said intake/outlet portion is formed, said end plate being brazed through brazing material to an outer formed plate which constitutes said tube element at said extreme end; and a plate thickness of said end plate is smaller than a plate thickness of said outer formed plate so that said end plate will deform more readily than said outer formed plate upon freezing of water in any pin holes in said brazing material, to thereby prevent deformation of said outer formed plate upon such freezing of water in any such pin holes in said brazing material.

* * * * *